US011236452B2

(12) United States Patent
Li et al.

(10) Patent No.: US 11,236,452 B2
(45) Date of Patent: Feb. 1, 2022

(54) DUAL-DRUM WASHING MACHINE

(71) Applicant: QINGDAO HAIER DRUM WASHING MACHINE CO., LTD., Shandong (CN)

(72) Inventors: Wenwei Li, Shandong (CN); Jinkai Wang, Shandong (CN); Xiao Ning, Shandong (CN); Xinguo Tian, Shandong (CN); Chongchao Duan, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 0 days.

(21) Appl. No.: 16/620,610

(22) PCT Filed: Jun. 14, 2018

(86) PCT No.: PCT/CN2018/091310
§ 371 (c)(1),
(2) Date: Mar. 10, 2020

(87) PCT Pub. No.: WO2018/228485
PCT Pub. Date: Dec. 20, 2018

(65) Prior Publication Data

US 2020/0385908 A1 Dec. 10, 2020

(30) Foreign Application Priority Data

Jun. 15, 2017 (CN) ..... 201710452878.2

(51) Int. Cl.
*D06F 31/00* (2006.01)
*D06F 37/22* (2006.01)
(Continued)

(52) U.S. Cl.
CPC ..... *D06F 31/00* (2013.01); *D06F 29/00* (2013.01); *D06F 37/22* (2013.01); *D06F 37/263* (2013.01);
(Continued)

(58) Field of Classification Search
CPC ..... D06F 29/00; D06F 31/00; D06F 37/22; D06F 37/263; D06F 37/264; D06F 37/267; D06F 58/06
See application file for complete search history.

(56) References Cited

U.S. PATENT DOCUMENTS

2007/0119072 A1* 5/2007 Kim ..... D06F 29/00 34/596
2015/0135777 A1 5/2015 Cho
(Continued)

FOREIGN PATENT DOCUMENTS

CN 2441827 Y 8/2001
CN 103225191 A 7/2013
(Continued)

OTHER PUBLICATIONS

Machine translation of CN203741590U to Jin et al. (Year: 2014).*
(Continued)

*Primary Examiner* — Joseph L. Perrin
(74) *Attorney, Agent, or Firm* — Buchanan, Ingersoll & Rooney PC

(57) ABSTRACT

A double-drum washing machine comprises a first outer drum and a second outer drum which are respectively provided with a drum inside, wherein the second outer drum is provided with a connecting part which protrudes out of a surface of the second outer drum and which is molded integrally, the connecting part extends towards the first outer drum along a radial direction from the surface of the second outer drum, and an end part of the connecting part is in
(Continued)

detachable connection with the first outer drum. Double drums of the double-drum washing machine are connected to be almost integrated, therefore, auxiliary fixed parts are reduced, and the connection between double drums is more stable, reliable and more compact, the vibration of the double-drum washing machine is effectively reduced during operation, the noise pollution of the double-drum washing machine is reduced, and additional counterweight is not required.

10 Claims, 4 Drawing Sheets

(51) Int. Cl.
*D06F 37/26* (2006.01)
*D06F 58/06* (2006.01)
*D06F 29/00* (2006.01)

(52) U.S. Cl.
CPC ..... *D06F 37/264* (2013.01); *D06F 37/267* (2013.01); *D06F 58/06* (2013.01)

(56) References Cited

U.S. PATENT DOCUMENTS

| | | | | |
|---|---|---|---|---|
| 2016/0160420 | A1 | 6/2016 | Lv et al. | |
| 2017/0350055 | A1* | 12/2017 | Li | D06F 39/087 |
| 2018/0251931 | A1* | 9/2018 | Li | D06F 39/08 |

FOREIGN PATENT DOCUMENTS

| | | | | | |
|---|---|---|---|---|---|
| CN | 203741589 | U | | 7/2014 | |
| CN | 203741590 | U | * | 7/2014 | D06F 31/00 |
| CN | 104278481 | A | | 1/2015 | |
| KR | 20010065084 | A | | 7/2001 | |
| WO | 02/12609 | A1 | | 2/2002 | |

OTHER PUBLICATIONS

International Search Report (PCT/ISA/210) dated Aug. 29, 2018, by the Chinese Patent Office as the International Searching Authority for International Application No. PCT/CN2018/091310.
Extended European Search Report dated Mar. 31, 2020, issued by the European Patent Office in corresponding European Application No. 18818358.6 (3 pages).

* cited by examiner

DUAL-DRUM WASHING MACHINE

TECHNICAL FIELD

The present disclosure relates to the technical field of clothing treatment apparatus, and in particular relates to a double-drum washing machine.

BACKGROUND

Along with social development and continuous improvement of requirements on life quality, a double-drum clothing treatment apparatus emerges at the right moment conforming to the development and requirements of the times, thereby not only saving placement space of the clothing treatment apparatus, but also providing more convenient clothing treatment requirements for users.

One of the important technical problems of the double-drum clothing treatment apparatus is how to set the double drums. In former conventional methods, two drums are respectively arranged in their respective frame, however, a gap exists between the two drums, thereby not only occupying more space, but also causing larger vibration noise in the use process.

Afterwards, the above double-drum clothing treatment apparatus is improved in some techniques, in which the two drums are connected, thereby a space of the double-drum clothing treatment apparatus is narrowed relatively, and also a noise is lowered to a certain degree. However, a regulating and balancing device which including a counterweight still needs to be added on an outer drum, thereby not only a cost of a washing machine is increased, but a reduction of vibration and noise is also unobvious. Moreover, the element connecting double drums is set separately, not only a mounting is tedious, but problems such as falling off are also easily caused due to vibration influence of a long-term operating process of the double-drum clothing treatment apparatus, and the stability is poor.

In view of the foregoing, the present disclosure is proposed.

SUMMARY

A technical problem to be solved in the present disclosure is to overcome shortcomings of the prior art, and the present disclosure provides a double-drum washing machine. Double drums of the double-drum washing machine are connected to be almost integrated, therefore, fewer auxiliary fixed parts are used, and the connection between double drums are more stable and reliable and more compact. Thereby a vibration of a double-drum washing machine during operation is effectively reduced, a noise pollution is reduced, and no additional counterweights are required, a production cost is lowered.

In order to solve the above-mentioned technical problems, a basic conception of the technical solution adopted in the present disclosure is as follows:

A double-drum washing machine includes a first outer drum and a second outer drum which are respectively provided with a drum inside, wherein the second outer drum is provided with a connecting part which protrudes out of a surface of the second outer drum and which is molded integrally, the connecting part extends towards the first outer drum along a radial direction from the surface of the second outer drum, and an end part of the connecting part is in detachable connection with the first outer drum.

Preferably, the connecting part includes a boss with a bottom part extending along a circumferential direction of an outer wall of the second outer drum, an end part of the boss is in detachable connection with the first outer drum and an upper side of the end part is provided with a curved end face, and the curved end face is matched with an outer wall of the first outer drum.

Preferably, one side of the boss is provided with multiple reinforcing ribs which extend along an axial direction of the second outer drum and along a direction vertical to the axial direction.

Preferably, the reinforcing rib which extends along an axial direction of the second outer drum has a step-shaped structure, and a height of the step-shaped structure close to the boss is larger than a height of the step-shaped structure far away from the boss. Preferably, two ends of the curved end face are not on the same height and are provided with mounting through holes, the first outer drum is provided with a bolt column which is molded integrally corresponding to the mounting through hole, the bolt column is provided with a hollow structure and penetrates through the mounting through hole, and a screw is connected and fixed with the hollow structure via a gasket.

Preferably, the connecting part is arranged at a site of an upper side of the second outer drum which is closed to a drum bottom of the second outer drum, and the bolt column is arranged at a site of a lower side of the first outer drum which is closed to a drum bottom of the first outer drum.

Preferably, the middle site of the boss is provided with a middle-through structure applicable to be held by hands.

Preferably, the double-drum washing machine includes a front connecting piece for connecting a front part of the first outer drum and a front part of the second outer drum, wherein the front connecting piece includes a U-shape structure on an upper part of the front connecting piece and a left and a right branch end arranged at the lower part of the U-shape structure, the left and right branch ends are arranged at different heights, two end parts of the U-shape structure and the left and right branch ends are provided with mounting through holes, the front parts of the first outer drum and the second outer drum are respectively provided with a bolt column which is molded integrally, the bolt column is provided with a hollow structure and penetrates through the mounting through hole, and the screw is connected and fixed with the hollow structure via a gasket.

Preferably, a circumferential wall of the bolt column is provided with multiple convex ribs which are distributed along an axial direction, and the mounting through holes are cylindrical holes.

Preferably, the mounting through holes are internally provided with grooves which correspond to the convex ribs.

Preferably, the curved end face is provided with an elastic buffer layer, and the elastic buffer layer is provided with a surface structure which is matched with an outer wall of the first outer drum.

The double-drum washing machine can be a washing machine including two drums or a washing and drying machine including two drums or a drying machine including two drums, etc.

After the above technical solution is adopted, the present disclosure has the following beneficial effects compared with the prior art:

1. A connecting part is molded integrally on an outer drum of the double-drum washing machine, the end part of the connecting part is connected with another outer drum, thereby the double drums are beneficial formed an almost integrated structure, and fewer auxiliary fixed parts are adopted. Looseness of a connecting structure of the double drums during vibration is not easily caused, and the connecting structure is more stable and reliable;

2. A structure of the connecting part extends from a surface of a first outer drum to another outer drum, thereby a placement clearance between the first outer drum and the second outer drum is utilized sufficiently with no need of occupying additional space, a structure of the double-drum washing machine is enabled to be more compact, and the vibration noise is lowered;

3. As to the double-drum washing machine, no additional counterweights need to be set, the setting of the parts are reduced, therefore, not only the cost is lowered, but also the fewer the parts are, the lower the possibility of fault is, and the stability of the overall structure is beneficial for improving;

4. The connecting part or a connecting piece of the double-drum washing machine is provided with a curved surface, etc. which is matched with an edge of the outer drum, and the curved surface can support the outer drum arranged thereon, thereby not only reducing burden of a supporting piece of an outer drum, prolonging service life, but also lowering noise caused by dramatic displacement change of an outer drum in an operating process; and 5. The mounting through holes for connecting the outer drums which arranged at an end part of the connecting part are arranged at different heights, after the outer drums are connected, the mounting through holes is beneficial for coordinating displacement change of the double drums during operation, thereby the vibration noise is lowered.

A further detailed description will be given below on specific embodiments of the present disclosure in combination with accompanying drawings.

BRIEF DESCRIPTION OF THE DRAWINGS

As a part of the present invention, accompanying drawings are used for providing a further understanding of the present disclosure. Illustrative embodiments and descriptions thereof of the present disclosure are used for explaining the present disclosure, rather than constituting an improper limitation to the present disclosure. Obviously, accompanying drawings described below are merely some embodiments, for those skilled in the art, other drawings can be obtained based on these drawings without any creative effort. In the drawings.

Figure 1:
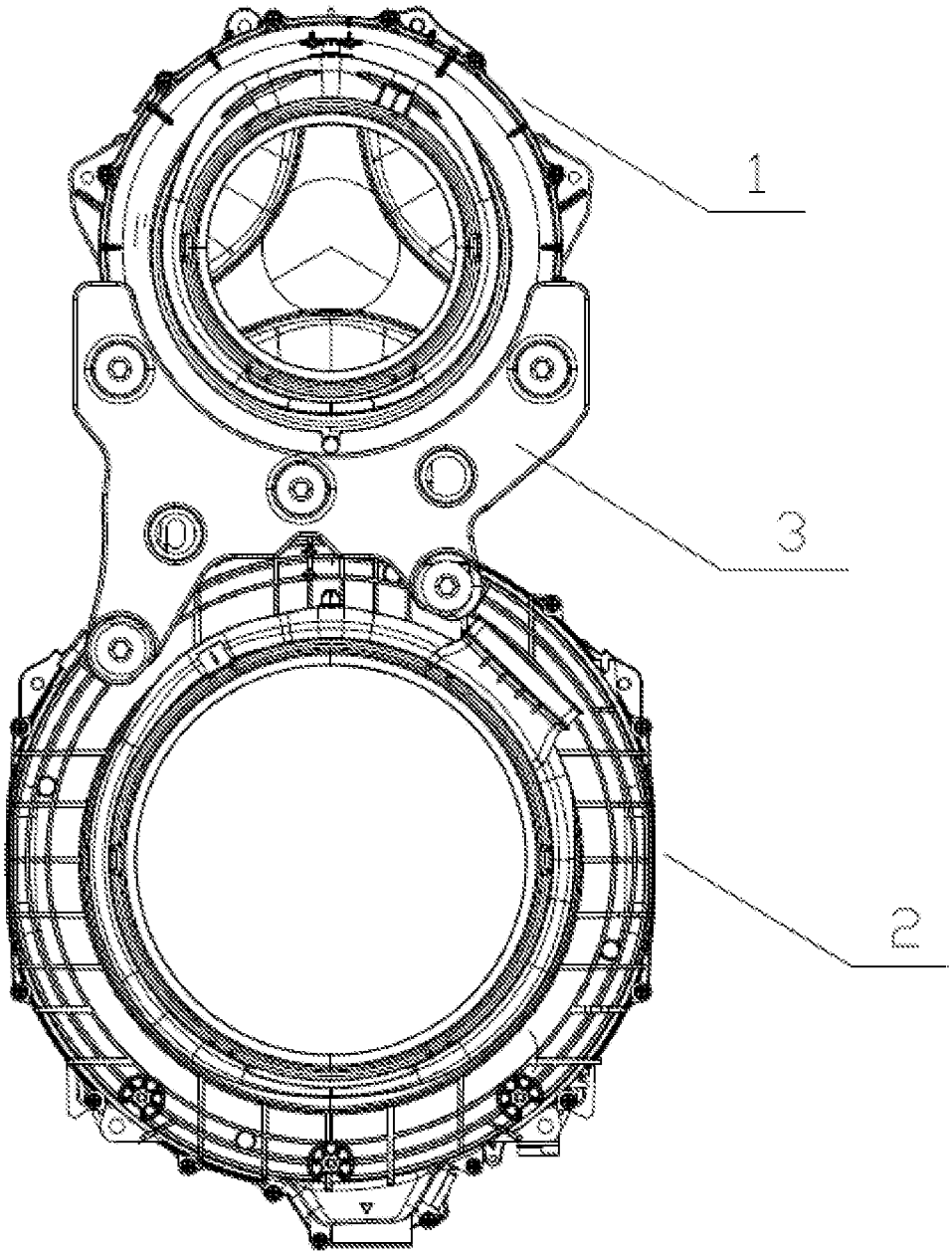
FIG. 1 is a schematic diagram of part of structures of the double-drum washing machine in the present disclosure.
Figure 2:
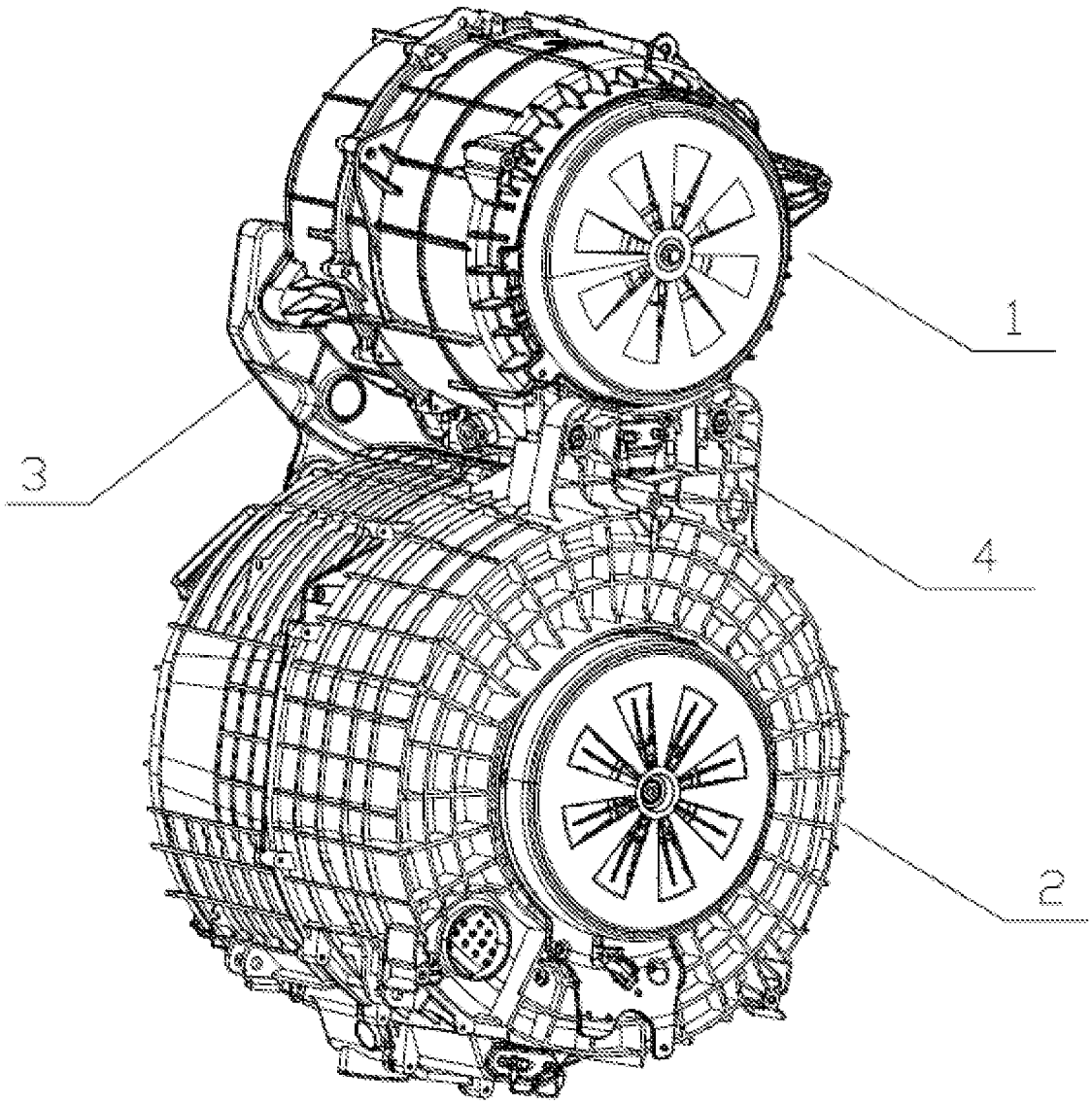
FIG. 2 is a schematic diagram of part of structures of the double-drum washing machine in the present disclosure.

In the drawings: 1, first outer drum; 2, second outer drum; 3, front connecting piece; 4, connecting part; 5, screw.

It should be noted that these drawings and text descriptions are not intended to limit a conceptual scope of the present disclosure in any form, but are to describe the concept of the present disclosure to those skilled in the art with reference to specific embodiments.

DETAILED DESCRIPTION

In order to make the object, technical solutions and advantages of the embodiments in the present disclosure clearer, a clear and complete description will be given below on technical solutions in the embodiments in combination with accompanying drawings in the embodiments of the present disclosure. The following embodiments are used for describing the present disclosure, rather than for limiting the scope of the present invention.

In the description of the present disclosure, it should be noted that, the directional or positional relationship indicated by such terms as "upper", "lower", "front", "rear", "left", "right", "vertical", "inner" and "outer" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless otherwise prescribed and defined definitely, the terms "installation", "interconnection" and "connection" should be understood in its broad sense. For example, the "connection" may be a fixed connection, may also be a detachable connection or an integrated connection; and the "connection" may be mechanical connection or electrical connection; and the "interconnection" may be directly interconnection, may also be an indirectly interconnection through an intermediate medium. The specific meaning of the above-mentioned terms in the present disclosure may be understood by those of ordinary skill in the art in light of specific circumstances.

Embodiment 1

Refer to FIGS. 1-4, a double-drum washing machine includes a first outer drum 1 and a second outer drum 2 which are respectively provided with a drum inside, wherein the second outer drum 2 is provided with a connecting part 4 which protrudes out of a surface of the second outer drum 2 and which is molded integrally, the connecting part 4 extends towards the first outer drum 1 along a radial direction from the surface of the second outer drum 2, and an end part of the connecting part 4 is in detachable connection with the first outer drum 1.

Preferably, the connecting part 4 extends towards a mounting clearance between the first outer drum 1 and the second outer drum 2 along a radial direction from the surface of the second outer drum 2.

The connecting part 4 includes a boss with a bottom part extending along a circumferential direction of an outer wall of the second outer drum 2, the end part of the boss is in detachable connection with the first outer drum 1, and an upper side of the end part is provided with a curved end face, and the curved end face is matched with an outer wall of the first outer drum 1.

The curved end face can lift part of a rear part of the first outer drum 1, thereby plays a certain supporting function. A displacement of the first outer drum 1 in operation due to vibration is avoided, a burden of connecting components of the first outer drum 1 is reduced, a service life is prolonged, and a vibration noise is lowered.

One side of the boss is provided with multiple reinforcing ribs which extend along an axial direction of the second outer drum 2 and along a direction vertical to the axial direction.

The reinforcing rib which extends along an axial direction of the second outer drum 2 has a step-shaped structure, and a height of the step-shaped structure close to the boss is larger than a height of the step-shaped structure far away from the boss.

The above reinforcing rib structure can make a structure of the connecting part 4 more firm and reliable, thereby the connection of the double drums is ensured to be more stable, and installation is facilitated when the reinforcing rib structure is arranged at one side.

Two ends of the curved end face are not on the same height and are provided with mounting through holes, the first outer drum 1 is provided with a bolt column which is molded integrally corresponding to the mounting through hole, the bolt column is provided with a hollow structure and penetrates through the mounting through hole, and a screw 5 is connected and fixed with the hollow structure via a gasket.

The connecting part 4 is arranged at a site of an upper side of the second outer drum 2 which is closed to a drum bottom of the second outer drum 2, and the bolt column is arranged at a site of a lower side of the first outer drum 1 which is closed to a drum bottom of the first outer drum 1.

The middle site of the boss is provided with a middle-through structure which is applicable to be held by hands. The through structure facilitates mounting and disassembling operations in a process of connecting a first outer drum 1 and a second outer drum 2, therefore, time and labor are saved.

The double-drum washing machine includes a front connecting piece 3 for connecting a front part of the first outer drum 1 and a front part of the second outer drum 2. The front connecting piece 3 includes a U-shape structure on an upper part of the front connecting piece 3 and a left and a right branch end arranged at the lower part of the U-shape structure. The left and right branch ends are arranged at different heights. Two end parts of the U-shape structure and the left and right branch ends are provided with mounting through holes. The front parts of the first outer drum 1 and the second outer drum 2 are respectively provided with a bolt column which is molded integrally. The bolt column is provided with a hollow structure and penetrates through the mounting through hole, and the screw 5 is connected and fixed with the hollow structure via a gasket.

A circumferential wall of the bolt column is provided with multiple convex ribs which are distributed along an axial direction, and the mounting through holes are cylindrical holes, as preferably, the mounting through holes are internally provided with grooves which correspond to the convex ribs.

The curbed end face is provided with an elastic buffer layer, and the elastic buffer layer is provided with a surface structure which is matched with an outer wall of the first outer drum 1. Thereby a noise is further lowered, an impacting effect between the first outer drum 1 and the boss is reduced, and the structure of the first outer drum 1 and the structure of the connecting part are protected.

After the above technical solutions are adopted, the present disclosure has the following beneficial effects compared with the prior art:

1. A connecting part is molded integrally on an outer drum of the double-drum washing machine, the end part of the connecting part is connected with another outer drum, thereby the double drums are beneficial formed an almost integrated structure, and fewer auxiliary fixed parts are adopted. Looseness of a connecting structure of the double drums during vibration is not easily caused, and the connecting structure is more stable and reliable;

2. A structure of the connecting part extends from the surface of a first outer drum to another outer drum, thereby a placement clearance between the first outer drum and the second outer drum is utilized sufficiently with no need of occupying additional space, the structure of the double-drum washing machine is enabled to be more compact, and the vibration noise is lowered;

3. As to the double-drum washing machine, no additional counterweights need to be set, the setting of the parts are reduced, therefore, not only the cost is lowered, but also the fewer the parts are, the lower the possibility of fault is, and the stability of the overall structure is beneficial for improving;

4. The connecting part or the connecting piece of the double-drum washing machine is provided with a curved surface, etc. which is matched with an edge of the outer drum, and the curved surface can support the outer drum arranged thereon, thereby not only reducing burden of a supporting piece of an outer drum, prolonging service life, but also lowering noise caused by dramatic displacement change of an outer drum in an operating process; and 5. The mounting through holes for connecting the outer drums which arranged at an end part of the connecting part are arranged at different heights, after the outer drums are connected, the mounting through holes is beneficial for coordinating displacement change of the double drums during operation, thereby the vibration noise is lowered.

Embodiment 2

A double-drum washing machine includes a first outer drum 1 which provides with a drum inside, and a second outer drum 2 which provides with a drum inside, and a connecting piece which connects the first outer drum 1 and the second outer drum 2 into a whole. At least one end part of the connecting pieces is molded integrally with the first outer drum 1 or the second outer drum 2, and the connecting piece is provided with the end part which is in detachable connection with the second outer drum 2 or the first outer drum 1.

The connecting piece includes a front connecting piece 3 for connecting the front parts of the first outer drum 1 and the second outer drum 2, and a connecting part 4 for connecting a rear part of the first outer drum 1 and a rear part of the second outer drum 2.

The front connecting piece 3 is molded integrally at the front part of the first outer drum 1 or the second outer drum 2, the end part of the front connecting piece 3 is in detachable connection with the front part of the second outer drum 2 or the first outer drum 1, or/and the connecting part 4 is molded integrally at the rear part of the first outer drum 1 or the second outer drum 2, and the end part of the connecting part 4 is in detachable connection with the rear part of the second outer drum 2 or the first outer drum 1.

Refer to FIGS. 1-4, in the present embodiment, the connecting part 4 is molded integrally with the second outer drum 2, and the connecting part 4 is provided with an end part which is in detachable connection with the first outer drum 1.

The end part of the connecting part 4 is connected with the rear part of the first outer drum 1 via a bolt.

The end part of the connecting part 4 is provided with two mounting through holes, the rear part of the first outer drum 1 is correspondingly provided with two bolt columns. The bolt column is molded integrally with the rear part of the first outer drum 1. The bolt column is provided with a hollow structure and penetrates through the mounting through hole. The screw 5 is connected with the hollow structure for fixation via a gasket.

The end part of the connecting part 4 is provided with a curved end face which is coincided to the contact edge at the rear part of the first outer drum 1. The connecting part 4 can lift part of the rear part of the first outer drum 1, thereby plays a certain supporting function. A displacement of the first outer drum 1 in operation due to vibration is avoided, a burden of connecting components of the first outer drum 1 is reduced, a service life is prolonged, and a vibration noise is lowered.

Figure 4:
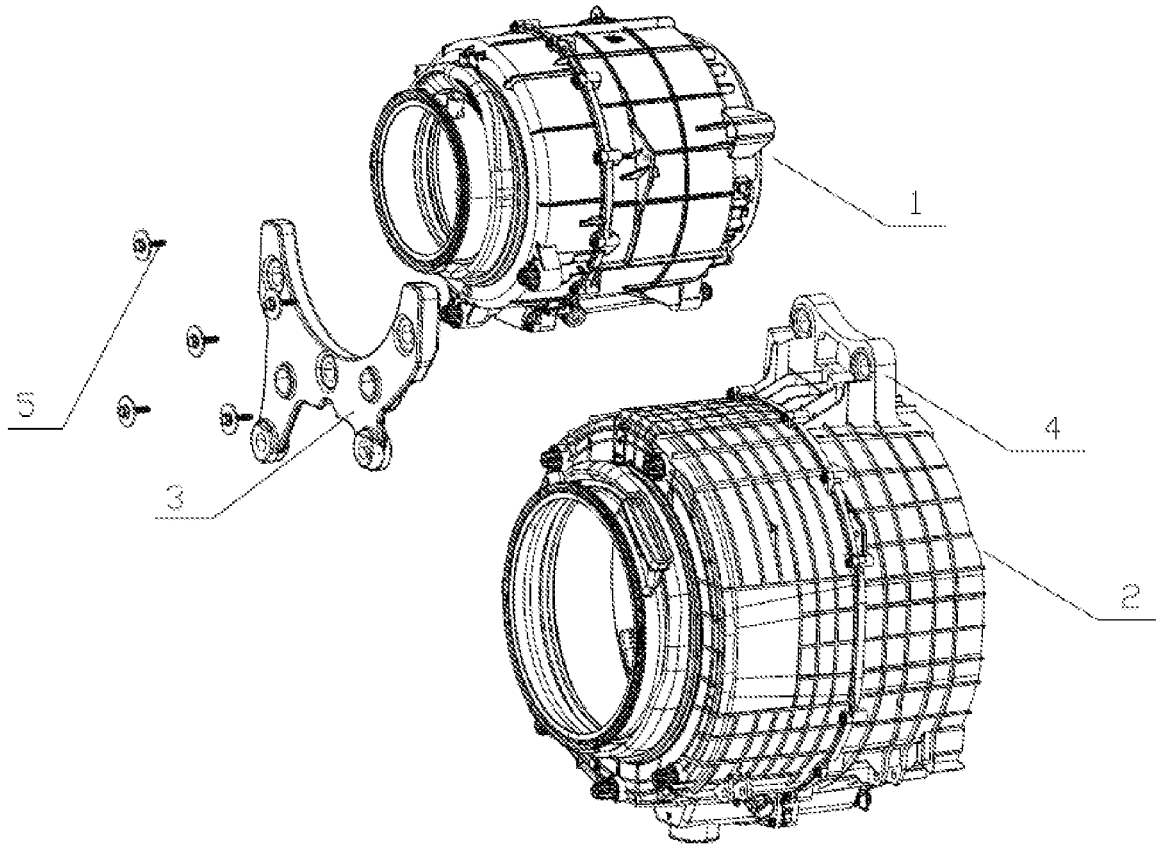
FIG. 4 is a schematic diagram of breakdown structural of the double-drum washing machine in the present disclosure.

Refer to FIG. 4, the connecting part 4 includes a boss with an upper end face being set to be a curved end face. Two ends of the curved end face are not at the same height and are provided with mounting through holes. The curved end face is matched with an edge of a rear part of the first outer drum 1 or the second outer drum 2. The rear part of the first outer drum 1 or the second outer drum 2 is provided with a bolt column, the bolt column is corresponding to mounting through holes which is at two ends of the curved end face;

One side of the boss is provided with multiple reinforcing ribs, some reinforcing ribs extend along an axial direction of the first outer drum 1 or the second outer drum 2, and some reinforcing ribs extend along a direction vertical to the axial direction. The reinforcing ribs which extend along an axial direction of the first outer drum 1 or the second outer drum 2 have a step-shaped structure.

The boss structure can effectively support the first outer drum 1, and since it is molded integrally with the second outer drum 2, the boss structure will not be loosened due to the weight of the first outer drum 1, thereby the connection between the first outer drum 1 and the second outer drum 2 is more stable and reliable. Moreover, the boss structure can play a certain buffer role when the first outer drum 1 is vibrated, thereby the noise is beneficial for lowered.

The middle site of the boss is provided with a middle-through structure. The middle-through structure can facilitate mounting and disassembling operations in a process of connecting the first outer drum 1 and the second outer drum 2, therefore, time and labor are saved.

As preferably, the curved end face of the boss is provided with an elastic buffer layer. The elastic buffer layer can further lower noise, and reduce a hit effect between the first outer drum 1 and the boss, and protect the structure of the first outer drum 1 and the boss structure.

Figure 3:
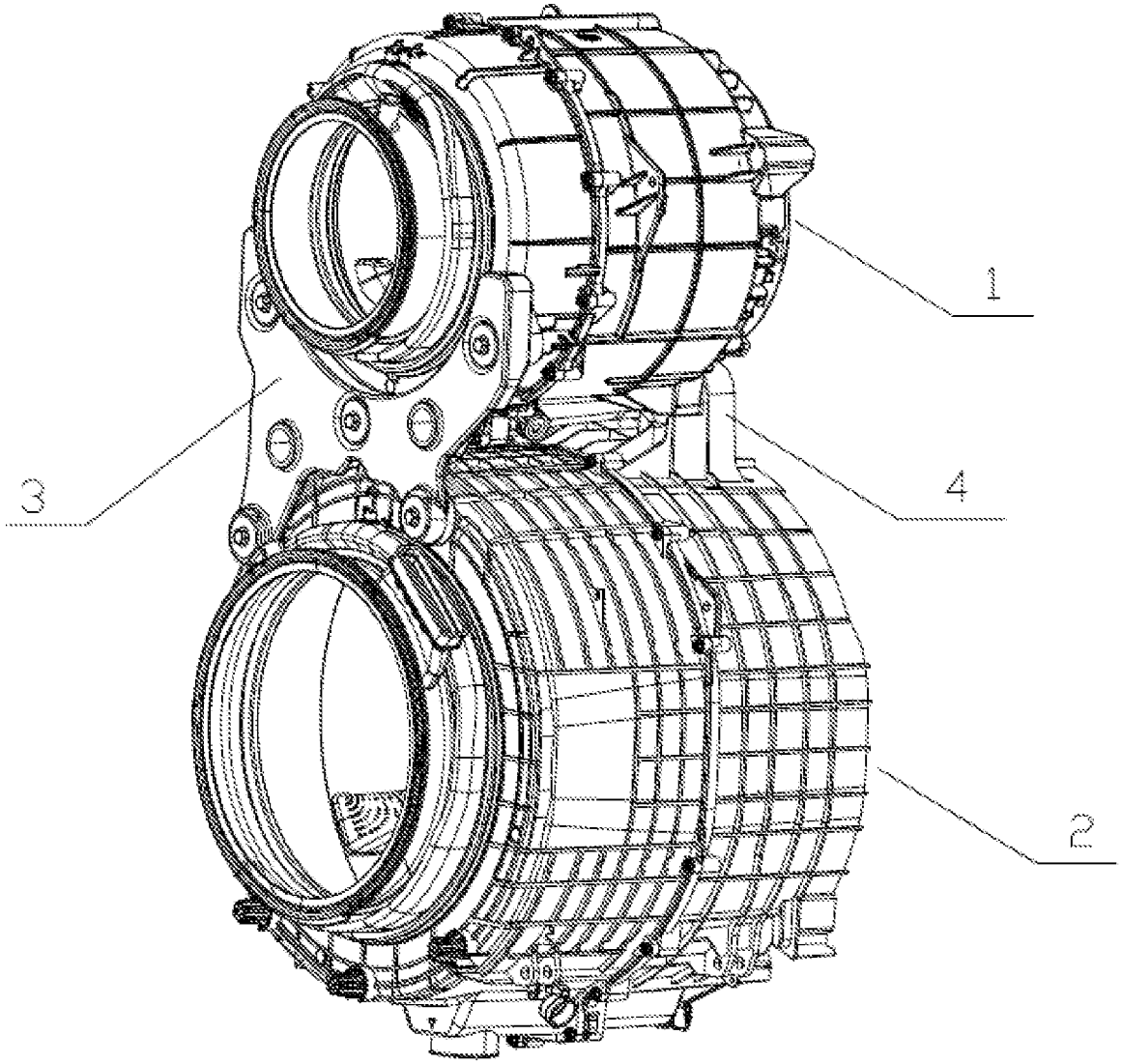
FIG. 3 is a schematic diagram of part of structures of the double-drum washing machine in the present disclosure.

Refer to FIGS. 1, 3 and 4, the structure of the front connecting piece 3 of the present embodiment is specifically as follows: a U-shape structure on an upper part of the front connecting piece 3 and a left branch end arranged at the lower part of the U-shape structure and a right branch end arranged at the lower part of the U-shape structure are included. The left branch end and the right branch end are arranged at different heights. Two end parts of the U-shape structure and the left branch end and the right branch end are provided with mounting through holes;

The front connecting piece 3 is configured to connect the front parts of the first outer drum 1 and the second outer drum 2. The front part of the first outer drum 1 is provided with a bolt column which corresponds to the mounting through holes at two end parts of the U-shape structure. An inner concave surface of the U-shape structure is matched with an outer contour of the first outer drum 1. The front part of the second outer drum 2 is provided with bolt columns which correspond to the mounting through holes of the left branch end and the right branch end.

The peripheral wall of the bolt column is provided with multiple convex ribs which are distributed along an axial direction, and the mounting through hole is provided with a groove which corresponds to the convex rib.

The bolt column is molded integrally with the front parts of the first outer drum 1 and the second outer drum 2, and then the overall stability of the connecting structure of the double drums can be improved.

The mounting through hole is arranged at a central position of a thickened circular truncated cone. The structure corresponding to the circular truncated cone of the bolt column is provided with a cylindrical base substrate. In this way, an impact to the connecting piece and the outer drum structure in a vibration process can be buffered, thereby not only the vibration noise is reduced, but also the connecting piece and the outer drum are protected, then the overall stability of the connecting structure of the double drums is improved.

Embodiment 3

The present embodiment differs from embodiment 1 as follows: the connecting part 4 is molded integrally at the rear part of the first outer drum 1, and the end part of the connecting part 4 is connected and fixed with the rear part of the second outer drum 2 via a bolt.

The end part of the connecting part 4 is provided with a mounting through hole, the rear part of the second outer drum 2 is correspondingly provided with a bolt column. The bolt column is molded integrally with the rear part of the second outer drum 2. The bolt column is provided with a hollow structure and penetrates through the mounting through hole. The screw 5 is connected with the hollow structure for fixation via a gasket.

Other structural characteristics can be set to be identical to or different from embodiment 1. The setting number of the bolt columns can be changed according to the number of the mounting through holes.

Embodiment 4

The present embodiment differs from embodiment 1 as follows: the front connecting piece 3 is molded integrally at the front part of the second outer drum 2, and the end part of the front connecting piece 3 is connected with the front part of the first outer drum 1 via a bolt. Meanwhile, the connecting part 4 is molded integrally at the rear part of the second outer drum 2, and the end part of the connecting part 4 is connected with the rear part of the first outer drum 1 via a bolt.

Other structural characteristics can refer to detailed description in embodiment 1, and other structural characteristics are not limited to the specific structure of embodiment 1.

For example, the specific structure of the front connecting piece 3 described in embodiment 1 can be used in the structure setting of the connecting part 4, similarly, the specific structure of the connecting part 4 can also be used in the structure setting of the front connecting piece 3.

The connecting structure of the double drums is more beneficial for setting the first outer drum 1 and the second outer drum 2 to be almost integrated, the structure is more compact and stable, the noise is lower, and the installation and detachment are also convenient.

Embodiment 5

The present embodiment differs from embodiment 1 as follows: the front connecting piece 3 is molded integrally at the front part of the first outer drum 1, and the end part of the front connecting piece 3 is connected with the front part of the second outer drum 2 via a bolt, meanwhile, the connecting part 4 is molded integrally at the rear part of the second outer drum 2, and the end part of the connecting part 4 is connected with the rear part of the first outer drum 1 via a bolt.

Other structural characteristics can refer to detailed description in embodiment 1, and other structural characteristics are not limited to the specific structure of embodiment 1.

The connecting structure of the double drums is more beneficial for setting the first outer drum 1 and the second outer drum 2 to be almost integrated, the structure is more compact and stable, the noise is lower, and the installation and detachment are also convenient.

What described above are only preferred embodiments of the present disclosure but are not intended to limiting the scope of the present disclosure in any forms. Although the present disclosure has been disclosed in terms of preferred embodiments, it is not limited thereto. Without departing from the scope of the technical solution of the present disclosure, any persons skilled in the present disclosure can make equivalent embodiments with various alterations and modifications as equivalent variations by utilizing the above-mentioned technical contents. However, without departing from the contents of the technical solution of the present disclosure, any simple changes, equivalent variations and modifications made according to the technical essence of the present disclosure shall all be covered within the scope of the technical solution of the present disclosure.

The invention claimed is:

1. A double-drum washing machine, comprising:

a first outer drum and a second outer drum which are respectively provided with a drum inside, wherein, the second outer drum is integrally molded with a connecting part protruding from a surface of the second outer drum, the connecting part extends towards the first outer drum along a radial direction from the surface of the second outer drum, and an end part of the connecting part is in detachable connection with the first outer drum;

the connecting part includes a boss, a bottom part of the boss extends along a circumferential direction of an outer wall of the second outer drum, an end part of the boss is in detachable connection with the first outer drum and an upper side of the end part is provided with a curved end face, and the curved end face cooperates with an outer wall of the first outer drum, a side of the boss is provided with multiple reinforcing ribs extending along an axial direction of the second outer drum and along a direction vertical to the axial direction, and the reinforcing ribs extending along the axial direction of the second outer drum have a step-shaped structure, and a height of the step-shaped structure close to the boss is larger than a height of the step-shaped structure far away from the boss.

2. The double-drum washing machine according to claim 1, wherein two ends of the curved end face are not on the same height and are provided with a mounting through hole, the first outer drum is provided with a bolt column which is molded integrally corresponding to the mounting through hole, the bolt column is provided with a hollow structure and penetrates through the mounting through hole, and a screw is connected and fixed with the hollow structure.

3. The double-drum washing machine according to claim 2, wherein the connecting part is arranged at an upper side of the second outer drum and close to a drum bottom of the second outer drum, and the bolt column is arranged at a lower side of the first outer drum and closed to a drum bottom of the first outer drum.

4. The double-drum washing machine according to claim 3, wherein the curved end face is provided with an elastic buffer layer, and the elastic buffer layer is provided with a surface structure which is matched with an outer wall of the first outer drum.

5. The double-drum washing machine according to claim 2, wherein the mounting through hole is a cylindrical hole.

6. The double-drum washing machine according to claim 5, wherein the curved end face is provided with an elastic buffer layer, and the elastic buffer layer is provided with a surface structure which is matched with an outer wall of the first outer drum.

7. The double-drum washing machine according to claim 2, wherein the curved end face is provided with an elastic buffer layer, and the elastic buffer layer is provided with a surface structure which is matched with an outer wall of the first outer drum.

8. The double-drum washing machine according to claim 1, wherein a middle portion of the boss is provided with an opening structure suitable for a person to hold by hand.

9. The double-drum washing machine according to claim 1, comprising a front connecting piece for connecting a front part of the first outer drum and a front part of the second outer drum, wherein the front connecting piece comprises a U-shape structure on an upper part of the front connecting piece, a left branch end arranged at a lower part of the U-shape structure and a right branch end arranged at the lower part of the U-shape structure, the left branch end and the right branch ends are arranged at different heights, two end parts of the U-shape structure, the left branch end and the right branch end are provided with the mounting through hole, the front part of the first outer drum and the front part of the second outer drum are respectively provided with the bolt column which is integrally molded, the bolt column is provided with a hollow structure and penetrates through the mounting through hole, and the screw is connected and fixed with the hollow structure.

10. The double-drum washing machine according to claim 9, wherein the curved end face is provided with an elastic buffer layer, and the elastic buffer layer is provided with a surface structure which is matched with an outer wall of the first outer drum.

* * * * *